US005090308A

United States Patent [19]

Wang

[11] Patent Number: 5,090,308

[45] Date of Patent: Feb. 25, 1992

[54] ALUMINUM CAN COMPACTOR FED WITH BULK CANS

[76] Inventor: Guang-Bin Wang, P.O. Box 55-1670, Taipei (10477), Taiwan

[21] Appl. No.: 624,898

[22] Filed: Dec. 10, 1990

[51] Int. Cl.[5] ..... B30B 15/30; B30B 9/32

[52] U.S. Cl. ..... 100/215; 100/293; 100/902

[58] Field of Search ..... 100/902, 215, 226, 245, 100/280, 281, 283, 293

[56] References Cited

U.S. PATENT DOCUMENTS

| | | | |
|---|---|---|---|
| 835,043 | 11/1906 | Stewart | 100/293 X |
| 2,723,618 | 11/1955 | Matthews | 100/215 X |
| 3,412,675 | 11/1968 | Killough et al. | 100/215 |
| 3,817,169 | 6/1974 | Bischoff | 100/283 X |
| 3,916,780 | 11/1975 | Heiser | 100/902 X |
| 3,919,932 | 11/1975 | Basuino | 100/293 X |
| 4,301,722 | 11/1981 | Balbo et al. | 100/293 X |
| 4,827,840 | 5/1989 | Kane | 100/280 |
| 4,962,701 | 10/1990 | Stralow | 100/215 |

*Primary Examiner*—Harvey C. Hornsby
*Assistant Examiner*—Stephen F. Gerrity

[57] ABSTRACT

An aluminum can compactor includes a main body fixed on a fixing plate mounted on a wall for receiving a can to be compacted loaded into a trough of the main body from a hopper mounted on the main body, a pressing member urged by a driving device connected with a handle bar, and a colleciton bag hung under the main body, whereby upon a lowering of the handle bar to forward the pressing member to squeeze a can in the trough, the compacted can can be discharged and collected into the collection bag for an efficient can-compacting operation.

1 Claim, 3 Drawing Sheets

ALUMINUM CAN COMPACTOR FED WITH BULK CANS

BACKGROUND OF THE INVENTION

Robert G. Salatka disclosed an aluminum can compactor in his U.S. Pat. No. 4,197,796 including a crushing means slidingly coupled to a guiding means, a first plate fixedly coupled to the guiding means for receiving a container and a handle assembly for urging the crushing means against the container for compacting the container, which however may have the following drawbacks:

1. Each can to be compacted should be snugly inserted between two recessed surfaces of the first plate and the crushing means so that a compression operation for compacting the can should be done in a sequence of "one-by-one", which may require much time for loading a can to be squeezed and unloading a finished compacted can after compression operation, thereby causing inconvenience for the compacting operation or reduction of productively for treating a lot of cans.

2. Upon a movement (stroke) of the crushing means for squeezing a can, the can under compression pressure may be irregularly deformed to possibly exert a stress especially at any bending portion of the squeezed can against the two recessed surfaces of the first plate and the crushing means to be accidentally leapt away from the compactor, because there is not provided with any guiding sleeve or protective cover for shielding the crushing means for limiting the can under compacting pressure. Therefore, the compacting operation may be incomplete and may be interrupted when a can under compression is leapt from the compactor.

The present inventor has found the drawbacks of the conventional can compactor and invented the present aluminum can compactor which may be fed with many cans at one time.

SUMMARY OF THE INVENTION

The object of the present invention is to provide an aluminum can compactor including a main body fixed on a fixing plate mounted on a wall for receiving a can to be compacted loaded into a trough of the main body from a hopper mounted on the main body, a pressing member urged by a driving device connected with a handle bar, and a collection bag hung under the main body, whereby upon a lowering of the handle bar to forward the pressing member to squeeze a can in the trough, the compacted can can be discharged and collected into the collection bag for an efficient can-compacting operation.

DETAILED DESCRIPTION

Figure 1:
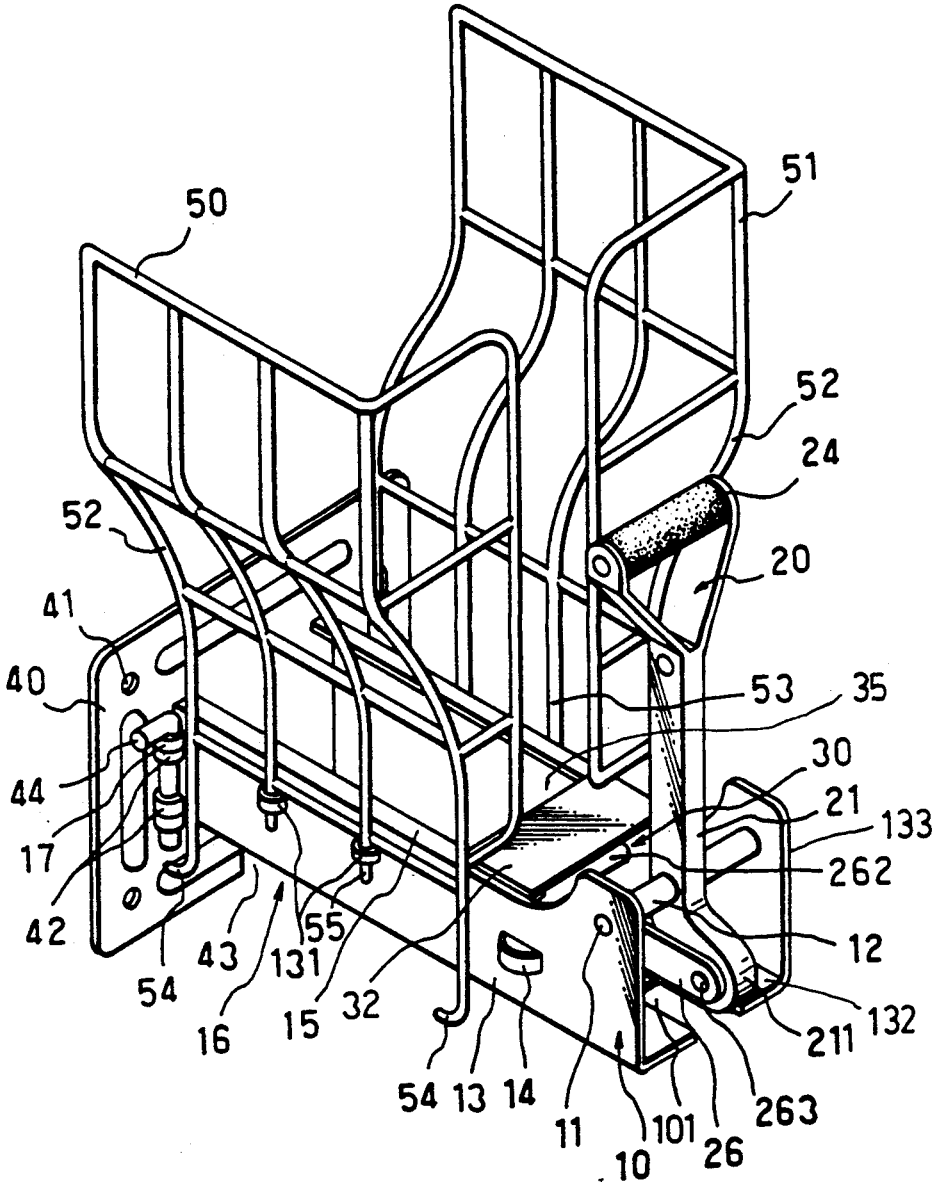
FIG. 1 is a perspective view of the present invention.

As shown in FIGS. 1-5, the present invention comprises: a main body 10, a driving means 20, a pressing means 30, a fixing plate 40, a hopper means 50, and a collection bag 60.

The main body 10 includes: an elongate trough 13 having a cross section generally U shaped, a shaft 11 for pivotally securing the driving means 20 on an outer portion of the body 10, and a discharge slot 16 formed in an inner bottom portion of the body 10.

The elongate trough 13 generally U shaped of its cross section includes a bottom plate 132, two vertical plates 133 extending upwardly from two side portions of the bottom plate 132, and two crimped edges 15 facing each other each edge bent inwardly from an upper portion of each vertical plate 133.

The fixing plate 40 includes a plurality of bolt holes 41 for inserting each bolt through the hole 41 to secure the plate 40 on a vertical wall W, two sets of base collars 42 respectively formed on two side portions of the plate 40 corresponding to two fixing collars 17 secured on two inner end portions of the main body 10, two pivot latches 44 each coupling each set of base collar 42 with each fixing collar 17 for securing the main body 10 on the fixing plate 40, and a lower notch 43 formed in a bottom portion of the plate 40.

The trough 13 of the main body 10 is generally perpendicular to the fixing plate 40 which is vertically mounted on a wall W. The main body 10 may also be fixed to the fixing plate 40 by welding or other fixing methods, or may be directly supported on a base frame (not shown) standing on a ground floor.

The driving means 20 includes: a handle bar 21, a gear wheel 25 secured with the handle bar 21, and a grip 24 formed on an upper portion of the bar 21. The handle bar 21 and grip 24 may be formed as shown in FIG. 1, 2, which includes, two supporting plates 221 fixed on and disposed around a central bar 21 by means of screws or rivets 23, and two bifurcate arm members 22 bifurcated upwardly from the two supporting plates 221 to be horizontally mounted with the grip 24. The handle bar 21 and grip 24 may also be simplified as shown in FIG. 1*a* by forming the grip 24 directly on a top portion of the bar 21.

The driving means 20 includes: a handle bar 21 having a grip 24 formed on an upper portion of the bar 21, a linking rod 26 having an inner end portion of the rod 26 pivotally secured with a pressing member 34*a* by an inner pivot 261 sheathed by an inner roller sleeve 262, and having an outer end portion of the rod 26 pivotally secured by an outer pivot 263 to a biasing rod 211 protruding downwardly outwardly from a lower portion of the handle bar 21 of the driving means 20. Two roller sleeves 12 are jacketed on the shaft 11 to be respectively disposed on two opposite sides of the handle bar 21 for stabilizing the driving operation of the driving means 20 and pressing means 30.

The pressing means 30 includes: a pressing member 34*a* pivotally connected with the driving means 20 slidably held in the tough 13 of the main body 10, and a shielding plate 32 secured on an upper portion of the pressing member 34*a*.

The hopper means 50 includes an upper hopper portion 51 diverging upwardly for receiving many cans therein, an intermediate tapered portion 52 tapered downwardly from the upper portion 51, a lower shute portion 53 contracted from the tapered portion 52 to communicate a top opening 35 defined between two crimped edges 15 of the main body 10, a plurality of bottom hooks 54 for hanging the collection bag 60 under the discharge slot 16 formed in the bottom portion of the trough 13, and a plurality of supporting leg members 55 inserted into plurality of sockets 131 formed on the main body 10 for mounting the hopper means 50 above the main body 10. The hopper means 50 may be formed with grate as shown in the figure or formed with several side-wall plates (not shown).

Figure 2:
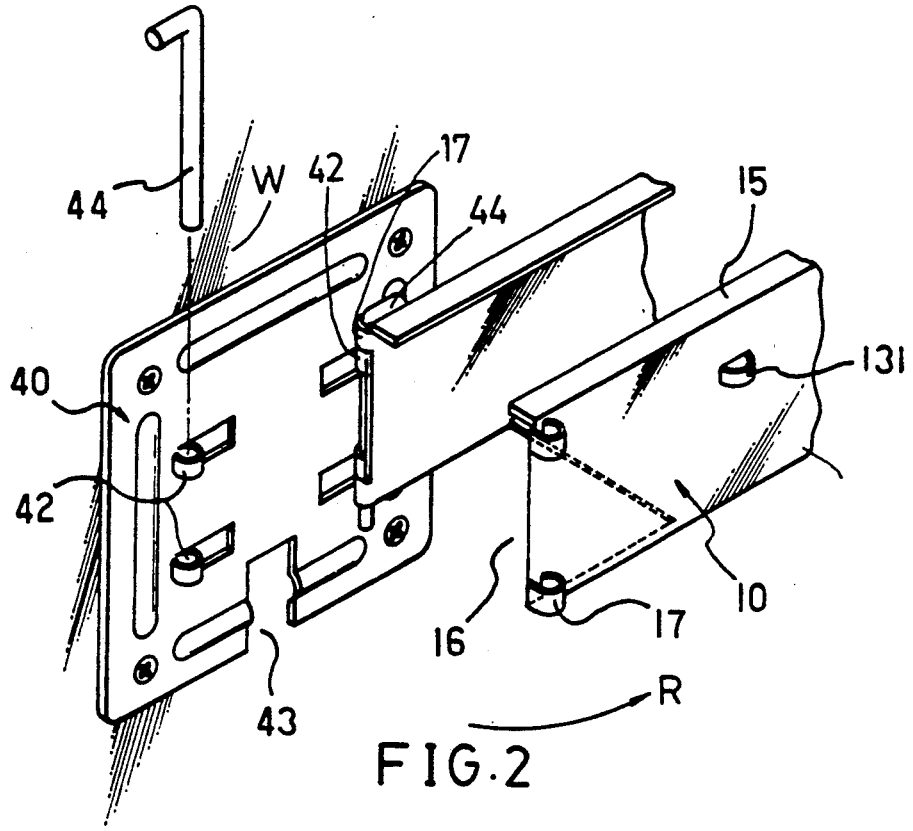
FIG. 2 shows a dismantled main body from a fixing plate in accordance with the present invention.
Figure 3:
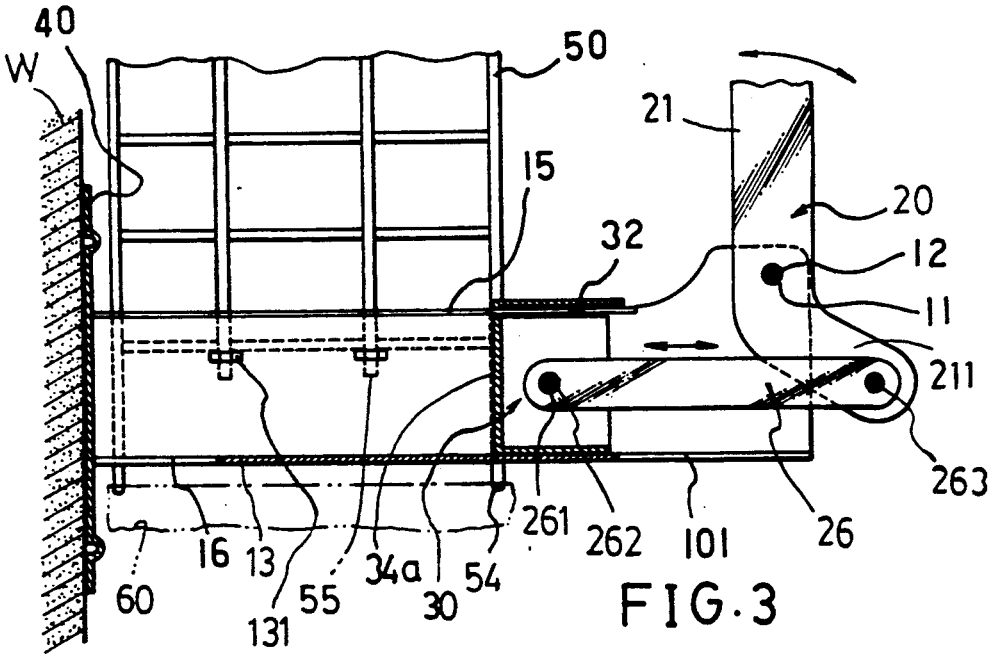
FIG. 3 is a partial section drawing of the present invention.
Figure 4:
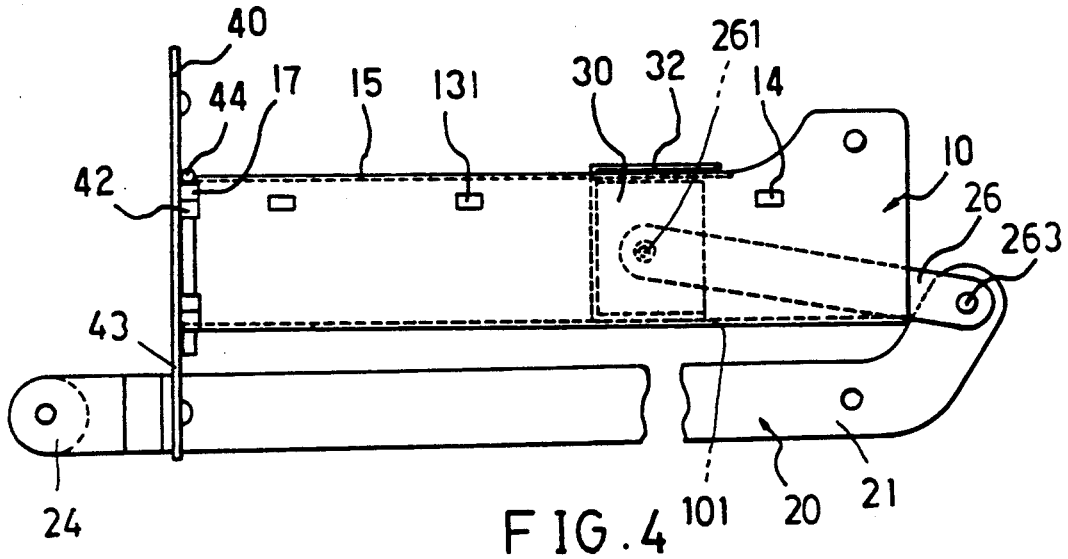
FIG. 4 shows a folded compactor of the present invention.
Figure 5:
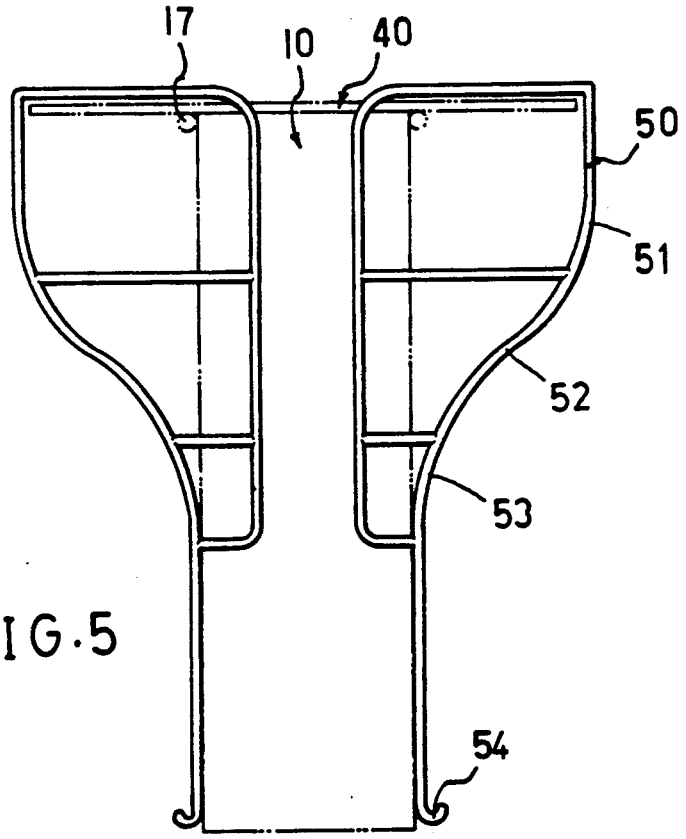
FIG. 5 shows a folded compactor of another style of the present invention.

As shown in FIG. 2, the present invention when not in use, may be folded by removing the pivot latch 44 and inserting the latch 44 into latch holder 14 formed on the main body 10, and by rotating the main body 10 about another pivot latch 44 in direction R for saving space without obstructing any passer-by.

In operating the present invention, the cans (bulk of cans) are thrown into the hopper means 50 to allow a lowest single can loaded into the trough 13 of the main body 10. Upon a lowering of the handle bar 21, the pressing member 34*a* will be driven inwardly to squeeze the can.

When further raising the handle bar 21 to retract the pressing member 34, the compressed can will be gravitationally dropped into the bag 60 through the slot 16. During the inward or outward movement of the pressing member 34*a*, the shielding plate 32 will cover the member 34*a* to preclude any intrusion of cans into the driving 20 and pressing means 30.

By repeating the lowering and raising operation of the handle bar 21, the pressing member 34*a* will be pushed inwardly and retracted outwardly for pressing the can and releasing the can so that a quick convenient operation for compacting the aluminum cans can be effected.

The can being squeezed is limited and slidably retained in the U-shaped trough 13 so that a smooth compression operation for compacting the cans can be achieved.

I claim:

1. An aluminum can compactor comprising:

a main body including an elongate trough having a cross-section of said trough generally U shaped, said trough perpendicularly secured to a fixing plate fixed on a wall, and having a discharge slot formed in an inner bottom portion of said main body; a driving means including a handle bar pivotally secured on an outer end portion of said trough and a link rod pivotally secured to a biasing rod protruding downwardly outwardly from a lower portion of said handle bar;

a pressing means including a pressing member secured to an inner end portion of said linking rod and slidably held in said elongate trough; and a hopper means mounted on said main body for receiving many cans therein and for loading said cans into said trough of said main body, having a collection bag hung under said main body, whereby upon a lowering of said handle bar to push said linking rod and said pressing member inwardly, a can loaded in said trough is squeezed and then discharged through said discharge slot into said collection bag when raising said handle bar to retract said pressing means;

said main body including two fixing collars formed on two inner end portions of said trough to be respectively coupled with two base collars formed on said fixing plate by two pivot latches for securing the main body on the fixing plate, a first pivot latch inserted in a first said fixing collar of said main body and a first said base collar of said fixing plate serving for pivotally rotating said main body about said first pivot latch for folding said main body when withdrawing a second pivot latch from a second fixing collar and a second base collar respectively formed on an opposite side of said main body and said fixing plate; and said hopper means including an upper hopper portion diverging upwardly for receiving cans therein, an intermediate tapered portion tapered downwardly from said upper hopper portion, a lower chute portion contracted downwardly from said intermediate tapered portion communicated with a top opening of said trough, a plurality of supporting leg members formed on a lower portion of said hopper means insertably fixed on said main body, and a plurality of bottom hooks formed on a bottom portion of said hopper means for hanging said collection bag positioned under said trough.

* * * * *